US006612056B1

(12) United States Patent
Thomas, II

(10) Patent No.: US 6,612,056 B1
(45) Date of Patent: Sep. 2, 2003

(54) VERSATILE ENLARGED HAND-SHAPED NOVELTY DISPLAY

(76) Inventor: Jan B. Thomas, II, 605 Ordrich, Las Vegas, CA (US) 89145

( * ) Notice: Subject to any disclaimer, the term of this patent is extended or adjusted under 35 U.S.C. 154(b) by 0 days.

(21) Appl. No.: 10/158,339

(22) Filed: May 31, 2002

(51) Int. Cl.[7] ..... G09F 21/02
(52) U.S. Cl. ..... 40/586; 446/26
(58) Field of Search ..... 40/586, 538, 594; 472/133; 446/26; D2/613, 615, 617

(56) References Cited

U.S. PATENT DOCUMENTS 4,455,963 A * 6/1984 Matsuo ..... 40/586
4,486,975 A * 12/1984 Harreld et al. ..... 40/586
5,432,991 A * 7/1995 Godleski ..... 446/26
D364,357 S * 11/1995 Ledgerwood, II ..... D2/617
D460,585 S * 7/2002 Johnson ..... D29/116.2

* cited by examiner

*Primary Examiner*—Gary Hoge
(74) *Attorney, Agent, or Firm*—J. E./McTaggart

(57) ABSTRACT

A versatile enlarged hand-shaped novelty display is formed from a flexible foam body, with front and rear sides, configured with an outline defining five articulated digits consisting of four fingers and a thumb. Patches of releasable engagement material, such as Velcro hook-and-loop type, are affixed to the novelty hand at specially selected locations, such as the finger tips, that enable an unprecedented number of hand signs, signals and/or gestures to be set up and retained as long as desired and then easily released and set up differently. Engagement patches at the digit extremities can engage an engagement strip extending across the palm. In addition, engagement patches in the vicinity of the fingernail location on the backs of two of the fingers can be engaged onto the thumb or to the front patch of an adjacent finger.

8 Claims, 3 Drawing Sheets

VERSATILE ENLARGED HAND-SHAPED NOVELTY DISPLAY

FIELD OF THE INVENTION

The present invention relates to the field of novelty display directed to public events such as sports games, and more particularly it relates to a novelty display shaped as an enlarged human hand with fingers and thumb capable of being readily configured into a large number of different shapes including many well-known hand signs and including the hand shape for holding a flag or pennant, each different hand shape being held in a stable condition for any desired time period by a special releasable engagement system.

BACKGROUND OF THE INVENTION

Enlarged simulated hands have become popular recreational novelties, both as a children's toy in the home and as often displayed both by children and adults at public gatherings such as concerts or sports events where, along with various signs, banners, flags and the like, the "big hands" are energetically flourished to catch the attention of others including players, officials, spectators and television viewers.

Hand simulators of known art for toys or public display are typically not intended or equipped to provide independent finger and thumb movement or shaping. Even if the hand simulator is made of flexible material such that the fingers and thumb can be moved to some extent, it is typical that any different shapes formed in this manner must be held in place manually, making it awkward to hold aloft and wave around in a desired manner.

Where "shape memory" capabilities have been provided in hand simulators, e.g. by utilizing disengagable fastenings, the number of different hand shapes available has been limited to only a few of the large number of well-known signs and gestures that can be formed by the human hand.

DISCUSSION OF KNOWN ART

There have been approaches seeking to provide limited flexing and shaping of one or more digits of novelty simulated enlarged hands along with some sort of disengagable fastenings or other "shape memory", typically such approaches have been limited as to the number of fingers and the number of different shapes possible.

U.S. Des. Pat. No. 364,357 to Ledgerwood shows a NOVELTY HAND showing circular areas suggestive of disengagable fastenings on the palm side only, that suggest the potential of forming a small limited number of finger/thumb shapes.

U.S. Des. Pat. No. 449,423 to Lowsky shows a NOVELTY GLOVE that displays eyes mouth and tongue of a "happy face".

U.S. Pat. No. 5,433,025 to Borghese discloses MOVABLE HAND SIGN AND METHOD OF ASSEMBLING THE SAME which is substantially non-enlarged such that the user's fingers extend nearly full length inside the hand sign so as to be capable of moving and bending individual fingers of the sign via the user's hand.

U.S. Pat. No. 4,850,052 to Matthews discloses a GLOVE FOR SPORTING EVENT SPECTATOR that envelopes the hand in the normal manner of a glove, featuring as novelty a pocket for containing a piece of cloth colored the same as an official penalty flag.

U.S. Pat. No. 4,582,317 to Provenzano discloses a MOVING HAND AMUSEMENT AND NOVELTY DEVICE with limited single-finger animation powered by a motor tucked into material attached to the rear of the wrist.

U.S. Pat. No. 4,486,975 to Harreld et al discloses an INFLATABLE NOVELTY DEVICE that includes a hand pocket and individual finger/thumb appendages that may be integrally connected to a main horse-shoe shaped body to form shapes that are generally limited to one or more extended fingers.

U.S. Pat. No. 4,455,963 to Matsua discloses a HAND SIMULATOR with five finger portions: the palm has holes in which the end of one or more corresponding finger portion may be inserted to give a manual sign or signal.

U.S. Pat. No. 6,108,817 to Kostelac discloses a HAND-SHAPED NOVELTY HAND SIGN having a plastic-covered foam rubber body portion with front and rear panels, configured with finger slits in the rear panel.

The foregoing patents and other known art fail to provide versatility and capabilities sought and obtained in the present invention.

OBJECTS OF THE INVENTION

It is a primary object of the present invention to provide an enlarged hand simulator that envelopes a human hand and displays an enlarged representation of a human hand in which the digits of the hand can be readily individually shaped to a straight or bent shape.

It is a further object to provide a readily releasable engagement system that holds one or more bent digits in place, retained temporarily in the bent shape for any desired time period and that is easily released.

It is a further object for the enlarged hand simulator of the invention to be made capable of a large number of different recognizable hand signals and/or signs.

It is a further object to make the enlarged hand simulator light in weight.

It is a still further object to provide an embodiment of the enlarged hand simulator that can be easily and economically manufactured and distributed.

SUMMARY OF THE INVENTION

The foregoing objects have been met by the invention, a flexible foam body is configured with two panel sides, front and back, with an outline defining five digits: thumb and index, third, fourth and fifth fingers. The foam body is fitted with areas of releasable engagement material, such as Velcro hook-and-loop type, affixed by self-adhesive at strategically selected locations, such as the finger tips, that enable any of an unprecedented number of hand signs, signals and/or gestures to be set up, displayed and retained as long as desired. In a preferred embodiment, five engagement patches affixed on the front side at the fingertips and thumb can engage selected mating patches including an engagement strip on the front side extending across the palm and two patches on the rear side, specially located near the ends of the index and third fingers.

DETAILED DESCRIPTION

Figure 1:
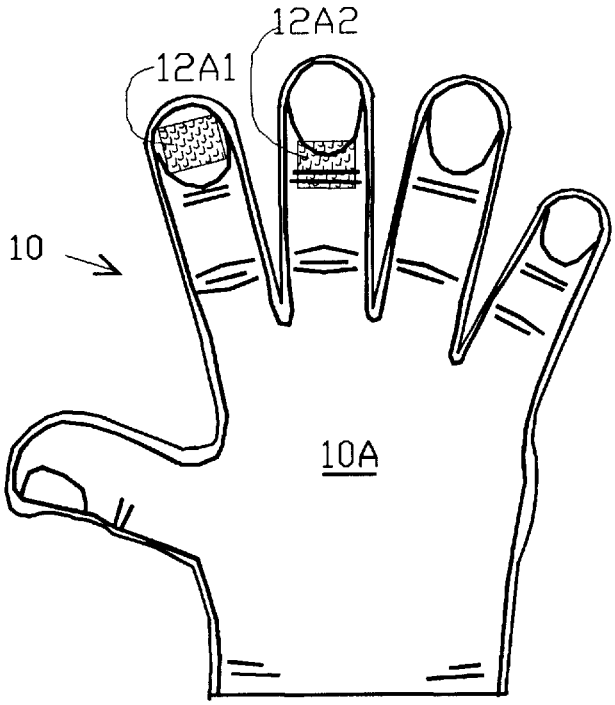
FIG. 1 is an elevational view of the back side of a novelty simulated hand in an illustrative embodiment of the present invention.

FIG. 1 is an elevational view showing the back side 10A of a novelty hand 10 in an illustrative embodiment of the present invention. The outline shown is typically cut from a slab of soft foam rubber material such that the articulated fingers and thumb can be readily bent to form the various shapes that are desired as being readily recognizable as those often formed by the human hand.

The foam material may optionally be covered with another material such as velvet; in either case the novelty hand may be colored and optionally marked on one or both sides with graphic artwork such as the outline and features of a hand along with a logo or name as shown, printed in white, black or a contrasting color.

A rectangular patch 12A1 of releasable engagement material is affixed to the back of the index finger in the fingernail region as shown, and a similar patch 12A2 is affixed to the back of the third finger, located offset from the fingernail as shown; these are for releasable engagement with areas of mating engagement material attached on the reverse (palm) side.

Figure 2:
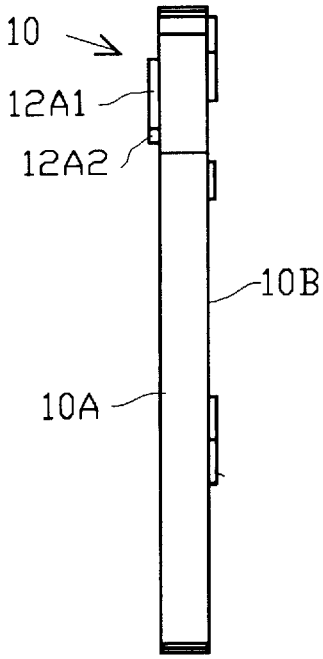
FIG. 2 is a right hand side view of the simulated hand of FIG. 1.

FIG. 2, a right hand edge view of the novelty hand 10 of FIG. 1, shows the back side 10A and the reverse (palm) side 10B to be flat parallel opposite sides of the foam rubber body.

Figure 3:
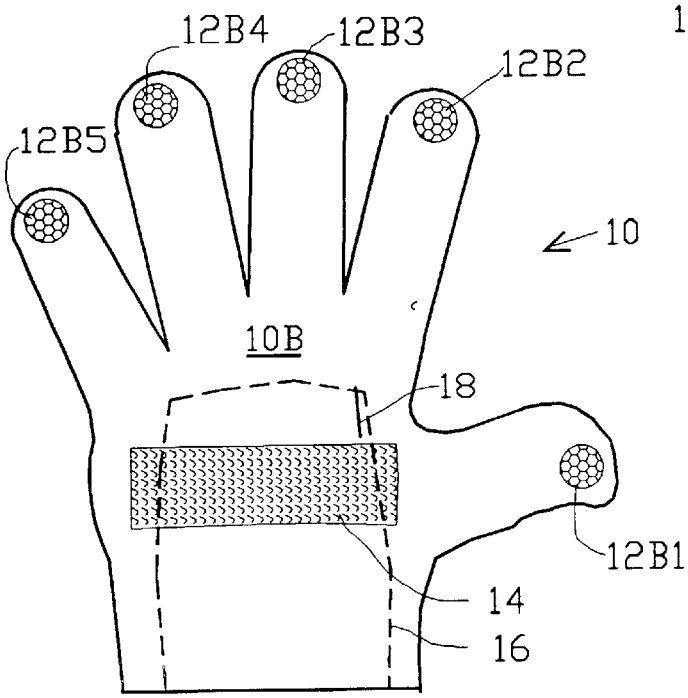
FIG. 3 is an elevational view of the palm side of the novelty hand of FIG. 1.

FIG. 3 is an elevational view of the palm side of the novelty hand of FIG. 1, showing five circular patches of mating engagement material 12B1–12B5 attached onto the five corresponding digits (thumb and four fingers) near the end or fingertip/pad region, and a strip 14 of mating releasable engagement material, attached to and extending across the central region of the palm surface 10B as shown.

The releasable engagement material may be of the well known Velcro type which utilizes two complementary mating surfaces known as hook and loop or clinging pile, and is available with self-adhesive backing for affixing the material in place. Patches 12A1 and 12A2 of FIG. 1, and strip 14 of FIG. 3 are of engagement material of one mating type (e.g. hook) while the five digit/pad patches 12B1–12B5 are of the opposite mating type (e.g. loop).

Releasable engagement material of a kind that utilizes a single self-engagable type of surface structure on both engaging surfaces could be used for all of the patches and the strip 14, subject to availability of such material with adequate holding properties.

To form various hand signs, one or more of the five digits of hand 10 may be bent and shaped so that the round patch 12Bn (n=1–5 as selected) at the tip of each digit selected engages the strip 14 and holds the digit in place until manually released. Additionally or alternatively, patches 12A1 and 12A2 of FIG. 1 can engage the front thumb patch 12B1, or another selected front finger patch 12Bn, typically that of an adjacent finger in a "crossed-finger" pattern.

A pocket 16, for accommodating a human hand, is formed by slitting the foam rubber material internally, through the bottom or wrist edge, to the extent indicated by the hidden outline of the pocket.

A slot 18 provided in the region of the palm side 10B, near the thumb, allows the shaft of a pennant or flag to be inserted into the pocket 16 where it can be retained passively or held and manipulated by the user's hand.

Figure 4:
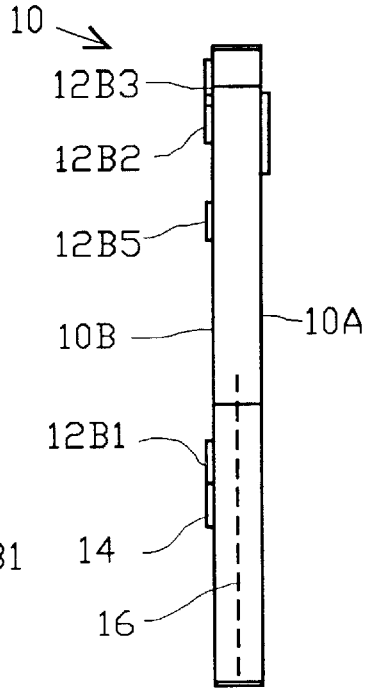
FIG. 4 is a right hand side view of the novelty hand of FIG. 3.

FIG. 4, a right hand edge view of the novelty hand 10 of FIG. 3, shows pocket 16 located midway between the palm side 10B and the back side 10A.

Figure 5:
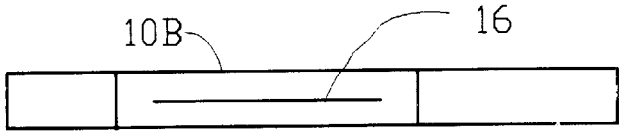
FIG. 5 is a bottom view of the novelty hand of hand of FIG. 3.

Pocket 16 extends to the bottom end, corresponding to the wrist region, where pocket 16 appears as a pocket-entry slot, as shown in FIG. 5, the bottom view.

Figure 6:
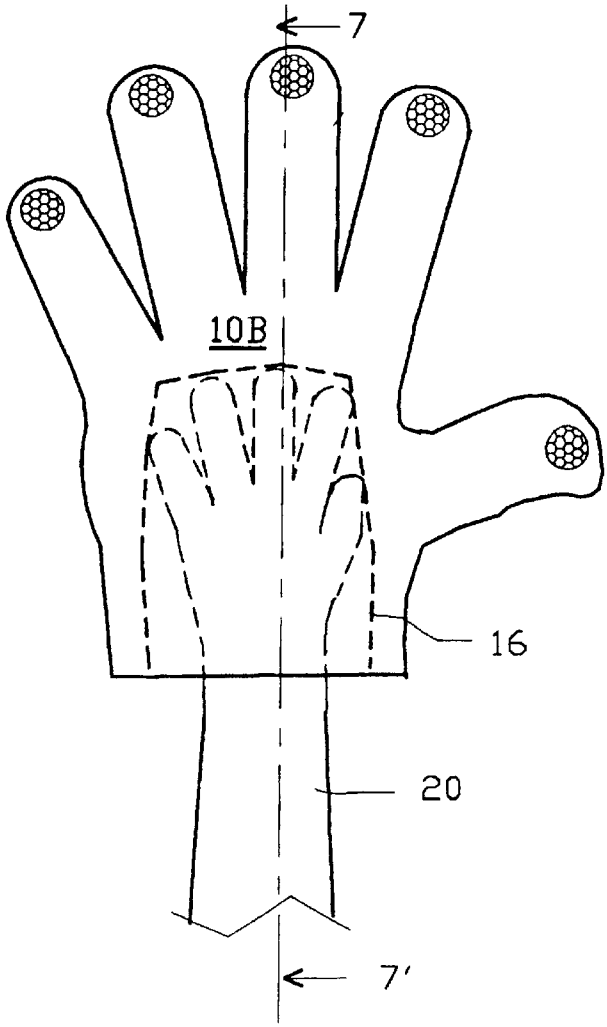
FIG. 6 is an elevational view of the novelty hand of FIG. 3 with a human hand inserted in the pocket.

FIG. 6 is an elevational view of the palm side 10B of novelty hand 10 as in FIG. 3, showing the user's right arm 20 with the hand inserted in pocket 16.

Figure 7:
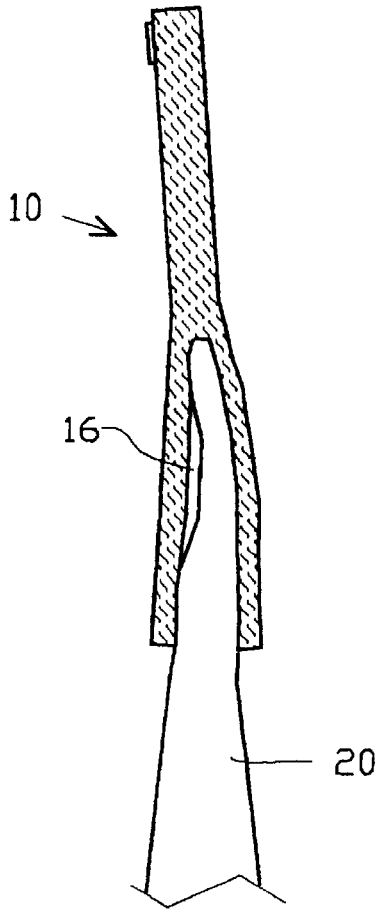
FIG. 7 is a cross-section taken through 7–7' of FIG. 6.

FIG. 7, a cross-section taken through 7–7' of FIG. 6, shows the pocket 16 spread open to contain the human hand of arm 20.

In the practice of the invention, patches 12A1 and 12A2 on the front side of the fingers (FIG. 1) can be used (a) to form crossed-finger configurations by engaging a front patch 12Bn of another digit or (b) when either of these fingers is bent and engaged onto strip 14, to further engage the thumb or other digits in the formation of special shapes and signs.

FIGS. 8–18 show different hand signs that can be made and retained in the novelty simulated hand of FIGS. 1–7.

Figure 8:
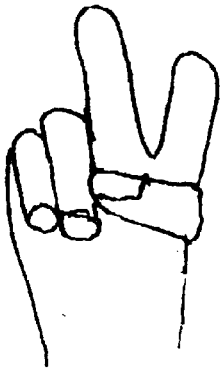
FIGS. 8–18 depict a variety of different hand signs as examples that can be made and retained in the novelty simulated hand of FIGS. 1–7.

FIG. 8 "V for victory" is formed by leaving the index and third fingers extended and engaging the other two fingers and thumb onto the palm strip.

Figure 9:
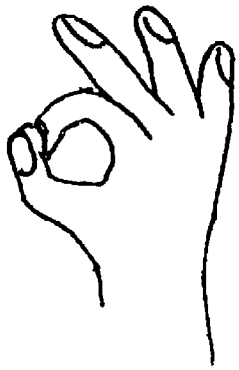

FIG. 9 is a perspective view of simulated hand 10 as in FIGS. 1–7 shown formed into an "OK" sign by engaging the front side thumb fastening patch (12B1 FIG. 3) onto the index finger rear patch (12A1 FIG. 1). A somewhat similar sign could be made using the third finger with its rear patch (12A2, FIG. 1).

FIGS. 10–18 are examples of additional different hand signs that can be formed by engaging one or more finger patches 12Bn onto the palm strip 14 (FIG. 3) in combination with other engagements.

Figure 10:
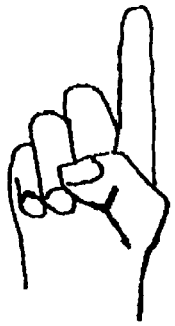

FIG. 10 shows a common finger sign that can mean "number one", "up" or a general warning; the single index finger points up, the other three fingers are folded down with their front patches engaged onto the palm patch, then the thumb patch is engaged onto the rear patch of the third finger. By turning the hand about 90 degrees, the index finger can be made to point in a desired horizontal direction, e.g. to point out an object or person.

Figure 11:
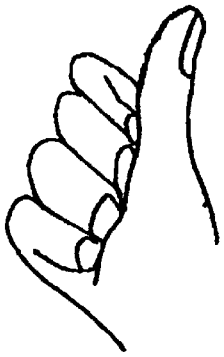
Figure 12:
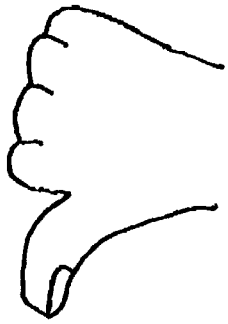

FIG. 11 shows a "thumbs up" sign of approval. This can be redirected downwardly as in FIG. 12 to show "thumbs down" disapproval. For both of these signs, the four front finger patches engage the palm strip.

Figure 13:
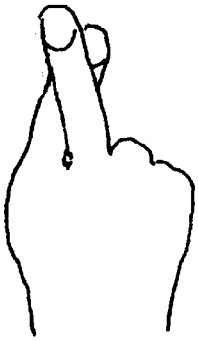

FIG. 13 depicts a typical crossed-finger pattern obtained by engaging the front patch of the third finger onto the rear patch of the index finger.

Figure 14:
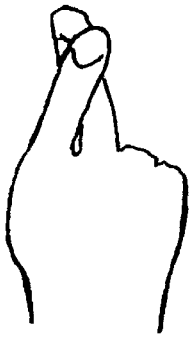

FIG. 14 depicts an alternative crossed-finger pattern: in a reversal of the pattern in FIG. 13, the front patch of the index finger is engaged onto the rear patch of the third finger.

Figure 15:
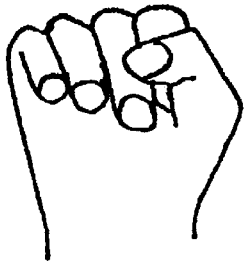

FIG. 15, depicting a clenched fist formed by engaging the front patches of four fingers onto the palm strip and engaging the thumb onto the rear patch of the index and/or third finger.

Figure 16:
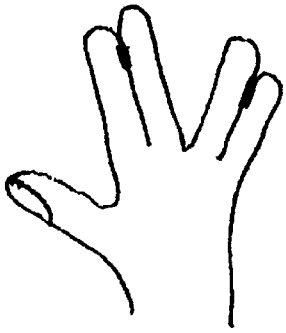
Figure 17:
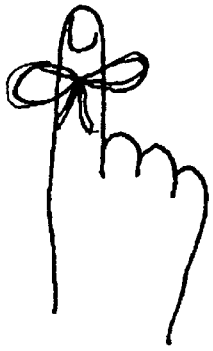

FIG. 16 depicts a double-finger V hand sign that can be formed by linking the appropriate two finger pairs in either of two methods: (a) a pair of engagement link strips of the type of engagement material that will engage patches 12B2/B3 and 12B4/B5 (FIG. 3), or (b) two additional pairs of engagement patches affixed onto interfacing sides of the second/third fingers and the fourth/fifth fingers near their ends as indicated, FIG. 17 signifies "don't forget" with a ribbon attached by a loop that engages the front and/or rear patch on the index finger.

Figure 18:
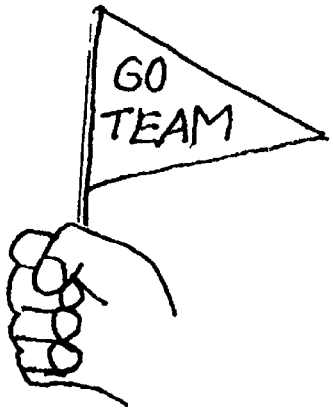

FIG. 18 depicts a hand holding a penant whose shaft can be inserted in slot 18 (FIG. 3).

The foregoing examples are only a fraction of many other different forms of finger signs and patterns that can be formed from the novelty hand of the present invention.

The locations shown for engagement patches in the preferred embodiment are regarded as optimal, however the invention can be practiced with fewer or more than the total number of patches shown, and with patches in locations other than those suggested.

The structure shown with parallel flat sides represents an economical and practical implementation that can be made from a flat slab of foam material; however the invention could be practiced with other overall shapes such as a fully three-dimensional hand with rounded shapes for the fingers and thumb.

While the drawings show the novelty simulated hand 10 in a right-hand version that would normally be placed on the user's right hand, a left-hand version that is a mirror image of the version shown can be easily made by simply reversing the original foam hand back-to-front, locating the engagement patches accordingly and modifying any impacted graphic artwork.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. An enlarged hand simulator for recreational use as a novelty display directed to sporting events and the like, comprising:

a body of resilient material shaped generally as an enlarged human hand having a front side corresponding to a palm side of a hand, and a rear side, said body being configured with (a) five articulated digits consisting of a thumb, index finger, third finger, fourth finger and fifth finger, and (b) a pocket made and arranged to accept insertion of a human hand through an access opening located in a wrist region;

a plurality of front engagement patches located on and affixed to the front side, each located near an extremity of a corresponding digit;

an engagement strip affixed to the front side in a location extending generally across a central palm region thereof, made and arranged to releasably engage selected ones of said front engagement patches as enabled by appropriate flexure of corresponding selected ones of the digits; and at least one rear engagement patch located on the rear side of a corresponding one of the digits near an extremity thereof, made and arranged to releasably engage at least one of the front engagement patches.

2. The enlarged hand simulator as defined in claim 1 comprising five front engagement patches of a first mating type each located in a frontal extremity region of a corresponding one of the digits.

3. The enlarged hand simulator as defined in claim 2 further comprising: a first engagement patch of the first mating material located on and affixed to the rear side of the index finger in a fingernail location, and a second engagement patch of the first mating material, located on and affixed to the rear side of the third finger, offset from a fingernail location in a direction toward a first joint location thereof.

4. The enlarged hand simulator as defined in claim 2 wherein said pocket is configured as an elongated slot located in a central region between opposite surfaces of the palm side and rear side, and extending over a major portion of the central palm region.

5. The enlarged hand simulator as defined in claim 2 further configured with an slit opening in a palm region thereof made and arranged to provide a passageway to the pocket suitable for accommodating a shaft of a pennant.

6. The enlarged hand simulator as defined in claim 1 wherein the enlarged hand simulator further comprises:

a first pair of releasable inter-finger engagement patches, disposed on and affixed to corresponding interfacing sides of the index finger and the third finger, and a second pair of releasable inter-finger engagement patches, disposed on and affixed to corresponding interfacing sides of the fourth finger and the fifth finger.

7. The enlarged hand simulator as defined in claim 1 wherein the front side and the rear side are made substantially flat and parallel to each other.

8. The enlarged hand simulator as defined in claim 1 wherein at least the rear side of said body is imprinted with graphic artwork including an outline of a hand having four fingernails and a thumbnail.

* * * * *